US005786828A

United States Patent [19]

Yamamoto

[11] Patent Number: 5,786,828

[45] Date of Patent: Jul. 28, 1998

[54] DETACHABLE PRINT UNIT HAVING UPDATABLE CONDITION MEMORY AND PRINTER USING THE SAME

[75] Inventor: Seiichiro Yamamoto, Shizuoka, Japan

[73] Assignee: Tokyo Electric Co., Ltd., Tokyo, Japan

[21] Appl. No.: 626,756

[22] Filed: Apr. 2, 1996

Related U.S. Application Data

[63] Continuation of Ser. No. 250,608, May 27, 1994, abandoned.

[30] Foreign Application Priority Data

May 27, 1993 [JP] Japan ..... 5-125563

[51] Int. Cl.[6] ..... B41J 29/46; B41J 29/00

[52] U.S. Cl. ..... 347/19; 347/7

[58] Field of Search ..... 347/7, 49, 87, 347/86, 20, 19; 400/703; 395/113

[56] References Cited

U.S. PATENT DOCUMENTS

| | | | |
|---|---|---|---|
| 4,345,262 | 8/1982 | Shirato et al. . | |
| 5,049,898 | 9/1991 | Arthur et al. | 346/139 C |
| 5,068,806 | 11/1991 | Gatten | 347/87 |
| 5,075,698 | 12/1991 | Aoki et al. . | |
| 5,276,461 | 1/1994 | Saito | 346/107 R |
| 5,365,312 | 11/1994 | Hillmann et al. | 355/206 |

FOREIGN PATENT DOCUMENTS

| | | |
|---|---|---|
| 0 421 806 | 4/1991 | European Pat. Off. . |
| 0 541 064 | 5/1993 | European Pat. Off. . |
| 0 556 011 | 8/1993 | European Pat. Off. . |
| 1-69376 | 3/1989 | Japan . |
| 4-275156 | 9/1992 | Japan . |
| WO 90/00974 | 2/1990 | WIPO . |

OTHER PUBLICATIONS

Louis "Storage of Operating Parameters In Memory Integral with Printhead", Xerox Disclosure Journal, vol. 8, No. 6, Nov./Dec. 1983, p. 503.

*Primary Examiner*—Huan H. Tran

*Attorney, Agent, or Firm*—Oblon, Spivak, McClelland, Maier & Neustadt, P.C.

[57] ABSTRACT

A printer is provided with at least one detachable print unit provided with a driven unit which is driven to print an image on a recording sheet. The condition of operation of the print unit is detected and the detected condition of operation of the print unit is stored in a data storage device that allows the updating of its contents. Thus, various kinds of information useful for the quality control of the printer and the print unit can be readily and surely collected and the collected information is stored in the print unit. The information useful for the quality control of the printer and the print unit can be read out from the data storage device after the print unit has been removed from the printer.

1 Claim, 3 Drawing Sheets

DETACHABLE PRINT UNIT HAVING UPDATABLE CONDITION MEMORY AND PRINTER USING THE SAME

This application is a Continuation of application Ser. No. 08/250,608, filed on May 27, 1994, now abandoned.

BACKGROUND OF THE INVENTION

1. Field of the Invention

The present invention relates to a replaceable print unit to be detachably mounted on the main unit of a printer, and a printer having a main unit and a replaceable print unit detachably mounted on the main unit.

2. Description of the Related Art

A printer, such as a thermal printer, is provided with a print unit provided with a replaceable print head, such as a replaceable thermal print head, and detachably mounted on a main unit, because the print head is expendable.

Referring to FIG. 3 showing a conventional thermal printer 1 by way of example, the thermal printer 1 is assembled by detachably mounting a print unit 30 having a replaceable thermal print head 2, i.e., a driven unit, on a main unit 3.

The thermal print head 2 of the thermal printer 1 has a plurality of linearly arranged heating elements 4, a driving IC (integrated circuit) 5 connected to the heating elements 4, and a connector 6 connected to the driving IC 5 and to an internal connector 11 for electrically connecting the print unit 30 to a main controller 10 included in the main unit 3 of the thermal printer 1.

The main controller 10 comprises a ROM (read-only memory) 7 initially and permanently storing pieces of information including control programs, a RAM (random-access memory) 8 temporarily storing printing data and such and allowing the retrieval of the stored data therefrom, and a CPU (central processing unit) 9 for processing data, connected to the ROM 7 and the RAM 8. The internal connector 11, a driving mechanism 12 including a feed motor and such, not shown, a display 13 for displaying pieces of information including the condition of the power source, failure in feeding a recording sheet and the like, and an external connector 14 through which to receive printing data from an external apparatus are connected to the main controller 10.

The main controller 10, the driving mechanism 12 and the associated components of the thermal printer 1 form a printing system that drives the replaceable thermal print head 2 to print an image on a recording sheet, not shown. A communication cable 16 connected to an external apparatus 15, such as a personal computer, that provides printing data is detachably connected to the external connector 14 of the thermal printer 1.

The thermal printer 1 receives printing data from the external apparatus 15 through the communication cable 16 and stores the same in the RAM 8 of the main controller 10. The CPU 9 drives the thermal print head 2 and the driving mechanism 12 according to the printing data stored in the RAM 8 and the control programs stored beforehand in the ROM 7 to print images with the thermal print head 2 on recording sheets successively fed by the driving mechanism 12. The print unit 30 is fabricated by mounting the thermal print head 2, the connector 6 and the driving IC 5 on a printed wiring board, not shown.

Since the thermal print head 2 of the thermal printer 1 is expendable, the print unit 30 must be replaced periodically with a new one. Usually, the number or the total length of recording sheets fed to the print unit 30 is counted by a mechanical counter, not shown, included in the driving mechanism 12 or by an electronic counter, not shown, comprised of the RAM 8 or the CPU 9 and included in the main controller 10, and a warning requesting the change of the print unit 30 is displayed on the display 13 when the count registered by the mechanical or electronic counter exceeds a predetermined limit value stored in the ROM 7 or a serviceman checks the count registered by the mechanical or electronic counter during maintenance work.

This conventional thermal printer 1 has the following problems. If the print unit 30 is replaced with a new one before the warning is provided and the counter is not reset, or the counter is reset by mistake while the thermal print head 2 is in operation, a false count is registered by the counter.

In some cases, the thermal printer 1 needs statistical data about the life of the thermal print head 2 and other components for quality control purposes. In such a case, a recording label, not shown, for recording the count when replacing the print unit 30 is attached to the print unit 30 and the count is entered in the recording label when the print unit 30 is replaced. The serviceman collects periodically replaced print units 30 carrying the recording labels recording the counts.

However, it is undesirable to put the operator under an obligation to enter the count in the recording label because recording the count is troublesome. Furthermore, the count entered in the recording label by the operator is not highly reliable because the operator is liable to fail in entering the count correctly, and collecting the recording labels with the count entered and processing the counts recorded on the thus collected recording labels by a personal computer or the like require very troublesome operations.

SUMMARY OF THE INVENTION

Accordingly, it is a first object of the present invention to provide a print unit capable of holding data useful for the quality control of the printer and the print unit.

A second object of the present invention is to provide a printer capable of readily and surely collecting data useful for the quality control of the printer and the print unit and of storing the collected data in its print unit.

A third object of the present invention is to provide a printer capable of providing accurate information about the life of its print unit.

The present invention provides a print unit capable of being detachably mounted on the main unit of a printer, comprising a driven unit to be driven by the main unit, and an erasable programmable data storage unit for storing data representing the operating experiences of the print unit to enable the print unit to hold data useful for the quality control of the printer and the print unit. After removing the print unit from the main unit of the printer, data stored in the data storage unit can be read.

The present invention provides also a printer detachably provided with a print unit comprising a driven unit and an erasable programmable data storage unit for storing data representing the operating experiences of the print unit, and capable of driving the driven unit of the print unit to print an image on a recording sheet. The printer detects the operating experiences of the print unit, stores data representing the detected operating experiences of the print unit in the data storage unit to enable the print unit to hold data useful for the quality control of the printer and the print unit. Thus, the data useful for the quality control of the print unit can be readily and surely stored in the data storage unit, and the data can be read from the data storage unit and processed after removing the print unit from the main unit.

DETAILED DESCRIPTION OF THE PREFERRED EMBODIMENTS

Figure 1:
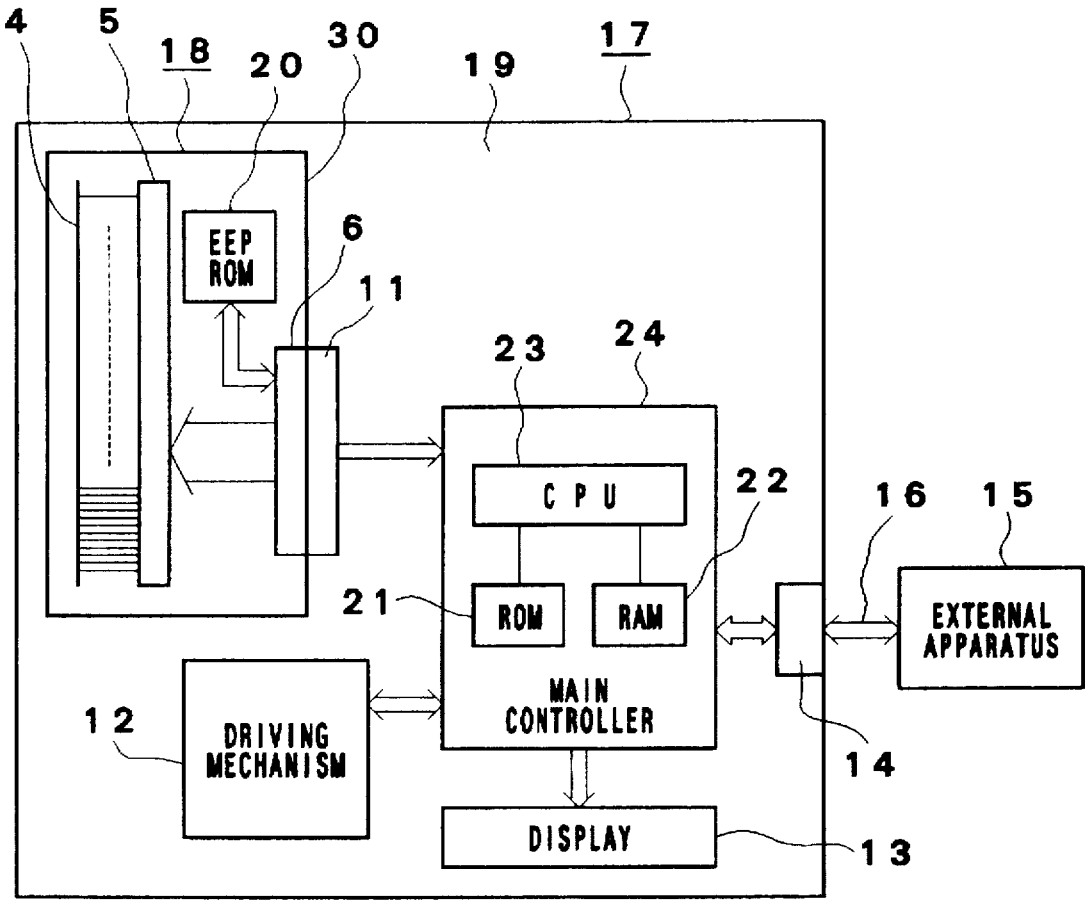
FIG. 1 is a block diagram of the electric circuit of a thermal printer in a preferred embodiment according to the present invention.

A thermal printer in a preferred embodiment according to the present invention will be described hereinafter with reference to FIGS. 1 and 2, in which parts like or corresponding to those previously described with reference to FIG. 1 are denoted by the same reference characters and the description thereof will be omitted.

Figure 2:
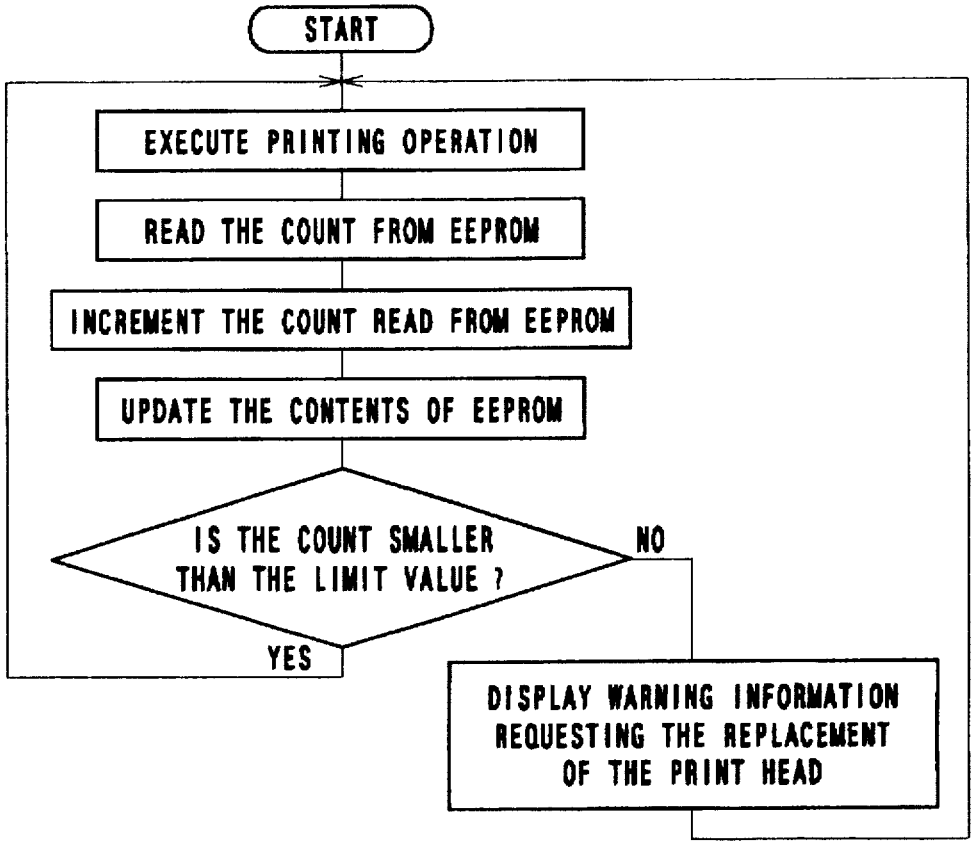
FIG. 2 is a flow chart of control processes to be carried out by the thermal printer of FIG. 1.
Figure 3:
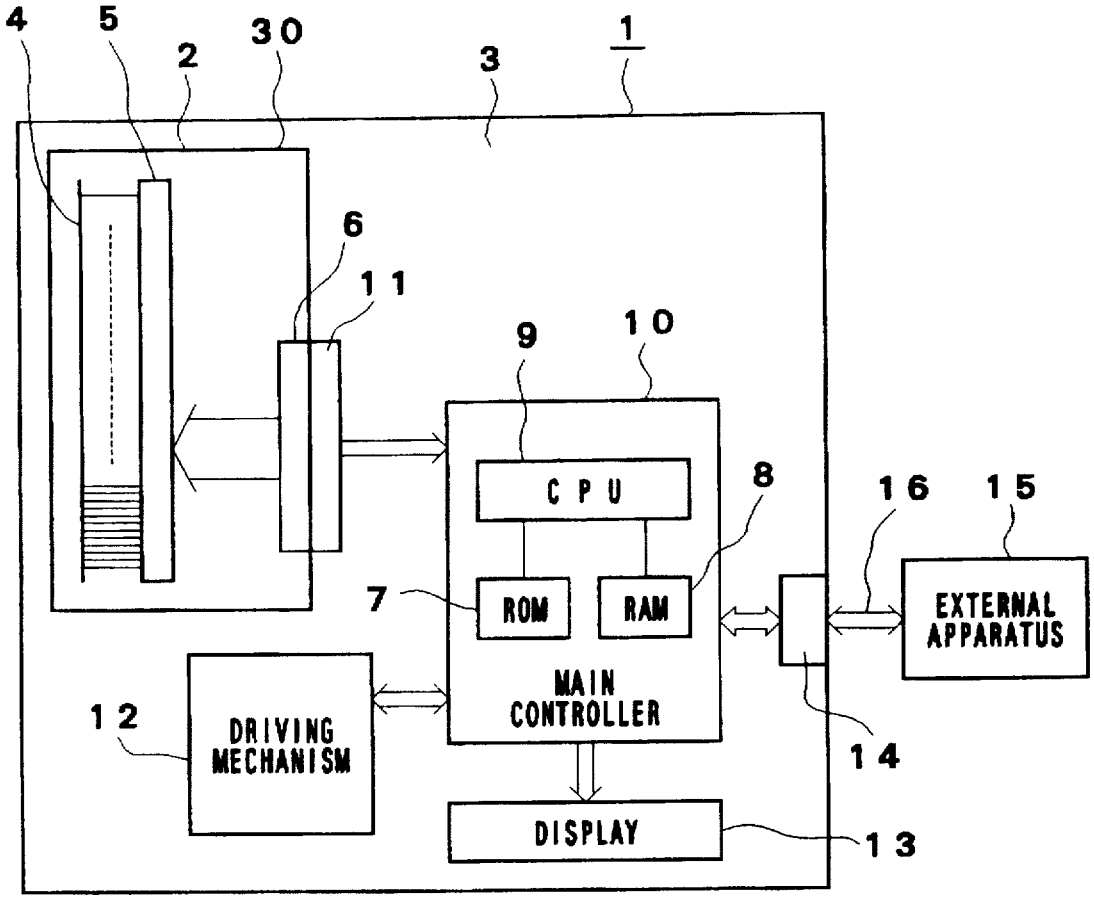
FIG. 3 (PRIOR ART)
FIG. 3 is a block diagram of the electric circuit of a conventional thermal printer.

Referring to FIGS. 1 and 2, a thermal printer 17 has a print unit 30 detachably mounted on a main unit 19.

The print unit 30 is formed by mounting a thermal print head 18, i.e., a driven unit, formed by linearly arranging a plurality of heating elements 4 and connecting a driving IC 5 to the heating elements 4, an EEPROM ( electrically erasable programmable read-only memory) 20, i.e., a data storage unit, for storing data, and a connector 6 connected to the driving IC 5 and the EEPROM 20 on a printed wiring board, not shown.

The main unit 19 comprises a main controller 24 comprising a ROM 21, a RAM 22 and a CPU 23 connected to the ROM 21 and the RAM 22, an internal connector 11, a driving mechanism 12, a display 13 and an external connector 14. the internal connector 11, the driving mechanism 12, the display 13 and the external connector 14 are connected to the main controller 24.

In the thermal printer 17, the printer mechanism for driving the detachable thermal head 18 so as to perform image printing on a recording sheet, not shown, comprises the main controller 24 and the driving mechanism 12. The thermal printer 17 includes a work measuring means for measuring the amount of work done by the print unit 30 including the thermal print head 18, and a data writing means for writing data representing the amount of work measured by the work measuring means in the EEPROM 20. The work measuring means and the data writing means are such constituted as to be controlled by the CPU 23 of the main controller 24. More concretely, the work measuring means counts pulses representing printing data applied to the thermal print head 18, and the progressively increasing number of the pulses counted by the work measuring means is stored in the EEPROM 20. The number of the pulses stored in the EEPROM 20 is incremented by one every time one pulse is counted.

A limit value, i.e., a maximum allowable count, is stored beforehand in the ROM 21 of the main unit 19 to limit the progressively increasing count stored in the EEPROM 20. A comparator included in the CPU 23 of the main controller 24 compares the count stored in the EEPROM 20 of the print unit 30 and the limit value stored in the ROM 21. Upon the detection of the increase of the count stored in the EEPROM 20 beyond the limit value, the CPU 23 executes a warning information output procedure to read warning information expressing that the count has exceeded the limit value from the ROM 21 and gives the warning information to the display 13 and an external apparatus 15, such as a personal computer.

The CPU 23 drives the thermal print head 18 and the driving mechanism 12 including a feed motor according to printing data received through the communication cable 16 from the external apparatus 15 and stored in the RAM 22, and a control program stored beforehand in the ROM 21. Then, the driving mechanism 12 feeds recording sheets successively and the thermal print head 18 prints images on the recording sheets.

The pulses representing printing data are counted by a counter, not shown, consisting of the CPU 23, the ROM 21 and the RAM 22. The count stored in the EEPROM 20 is incremented by one every time one pulse representing printing data is counted by the counter to update the count stored in the EEPROM 20.

After updating the count stored in the EEPROM 20, the CPU 23 of the main unit 19 compares the limit value stored beforehand in the ROM 21 and the count stored in the EEPROM 20. If the count stored in the EEPROM 20 is smaller than the limit value stored in the ROM 21, the printing operation is continued.

Upon the detection of the increase of the count beyond the limit value while the thermal printer 17 is in printing operation, the CPU 23 reads the warning information requesting the replacement of the print unit 30 from the ROM 21, and gives the warning information to the display 13 to make the display 13 display the warning information, to the external apparatus 15 or to the thermal print head 18 to make the thermal print head 18 print the warning information on the recording sheet. The thermal printer 17 continues the printing operation even if the warning information is provided.

The warning information prompts the operator of the thermal printer 17 to replace the print unit 30. Thus, the time when the expendable print unit 30 must be replaced with a new one can be accurately determined and it is possible to prompt the operator to replace the print unit 30 with a new one after the print unit 30 has done an appropriate amount of work. The operator need not perform troublesome work for resetting the counter, not shown. Since the thermal printer 17 need not be provided in its driving mechanism 12 with any counter for counting the number or the total length of recording sheets fed to the print unit 30, the thermal printer 17 can be formed in a compact, lightweight construction, and the productivity of the production line for manufacturing the thermal printer 17 can be enhanced.

Since the count is stored in the EEPROM 20 included in the print unit 30 removed from the main unit 19, the statistical data of the life of the thermal print head 18 can be readily and surely obtained by reading the counts stored in the EEPROMs 20 of used print units 30 collected from the users.

Although the present invention has been described as applied to the print unit 30 including the thermal print head 18 of the thermal printer 17, the present invention is not limited thereto in its practical application; the present invention is applicable also to other printers and other print units, such as end face light emission type electroluminescence printers (EL printers), end face light emission type electroluminescence print heads (EL heads), electrophotographic printers and organic photoconductive conductor drums (OPC drums) for electrophotography.

The EEPROM 20 included in the print unit 30 in this embodiment as a data storage device may be substituted by a nonvolatile storage, such as a flash memory.

Although the thermal printer 17 in this embodiment uses the number of pulses of printing data as the amount of work of the thermal print head 18, the work measuring means measures the amount of work and the data writing means writes the data representing the amount of work measured by the work measuring means in the EEPROM 20, the amount of work done by the thermal print head 18 may be represented by the number of electric driving pulses applied to the driving mechanism 12 by the main controller 10 or the total operating time of the thermal print head 18 measured by the main controller 10.

Although the printer unit 30 in this embodiment stores only the number of pulses representing the printing data is stored as an amount of work done by the thermal print head 18 in the EEPROM 20, it is possible to store various kinds of information, other than the number of pulses representing the amount of work done by the thermal print head 18, useful for the quality control of the thermal print head 18 and the thermal printer 17, such as the date and time of operation of the thermal print head 18, the number of replaced print units and the frequency of jamming may be stored in the EEPROM 20.

In the thermal printer 17 in this embodiment, the EEPROM 20 for storing various kinds of information is incorporated into the thermal print head 18 and the data writing means incorporated into the main controller 24 included in the main unit 19 writes the amount of work done by the thermal print head 18 in the EEPROM 20 incorporated into the printer unit 30 to facilitate the collection of various kinds of information. However, the present invention is not limited in its practical application to the foregoing embodiment specifically described herein; the data writing means may be incorporated, for instance, into the thermal print head to enable the thermal print head to record the amount of work when the same is used on a conventional printer.

Although the thermal printer in this embodiment continues its printing operation even after the CPU 23 has decided that the count stored in the EEPROM 20 has exceeded the limit value and the warning information has been provided, the printing operation of the thermal printer 17 may be interrupted when the warning information is provided.

What is claimed is:

1. A method for monitoring a thermal print head, comprising the steps of:

recording information indicating usage of the thermal print head in a memory mounted on the thermal print head;

monitoring the information stored in the memory to determine a remaining lifetime of the thermal print head after which the thermal print head should be replaced;

indicating a warning indicating to an operator that the thermal print head needs to be replaced based on a result of the monitoring step;

removing the print head from a printer;

reading the information in the memory; and processing the information which has been read from the memory.

* * * * *

UNITED STATES PATENT AND TRADEMARK OFFICE

CERTIFICATE OF CORRECTION

PATENT NO. : 5,786,828
DATED : July 28, 1998
INVENTOR(S) : Seiichiro Yamamoto

It is certified that error appears in the above-identified patent and that said Letters Patent is hereby corrected as shown below:

Item [73], the Assignee information, is incorrect. It should read as follows:

--[73] Assignee: Kabushiki Kaisha TEC, Shizuoka, Japan--

Signed and Sealed this

Third Day of July, 2001

Nicholas P. Godici

*Attest:*

*Attesting Officer*

NICHOLAS P. GODICI
*Acting Director of the United States Patent and Trademark Office*